US005387165A

United States Patent [19]

Warren

[11] Patent Number: 5,387,165

[45] Date of Patent: Feb. 7, 1995

[54] RECREATIONAL EQUIPMENT JUNCTION BOX

[75] Inventor: Mitchell R. Warren, Charlotte, N.C.

[73] Assignee: Soft Play, Inc., Charlotte, N.C.

[21] Appl. No.: 192,771

[22] Filed: Feb. 7, 1994

Related U.S. Application Data

[63] Continuation of Ser. No. 954,825, Oct. 1, 1992, abandoned.

[51] Int. Cl.[6] ..... A63B 17/00; F16D 1/00; A01K 1/00

[52] U.S. Cl. ..... 482/35; 446/7; 446/476; 119/702; 403/170

[58] Field of Search ..... 446/7, 85, 89, 9, 123, 446/230, 231, 232, 476, 477, 478; 482/23, 35, 36; 119/15, 15.1, 28.5, 702, 703; 403/170, 217, 231, 241, 24

[56] References Cited

U.S. PATENT DOCUMENTS

| | | | |
|---|---|---|---|
| 1,122,632 | 12/1914 | Phelps | 174/65 R |
| 1,311,376 | 7/1919 | Bissell et al. | 174/65 R |
| 3,051,164 | 8/1962 | Trexler | 119/15 |
| 3,299,253 | 1/1967 | Lawson, Jr. | 119/15 X |
| 3,367,308 | 2/1968 | Quattrone et al. | 119/15 |
| 3,439,108 | 4/1969 | Zerwes | 174/65 R |
| 3,561,757 | 2/1971 | Schillig | 482/35 |
| 3,585,273 | 6/1971 | Paul | 174/65 R |
| 3,666,266 | 5/1972 | Noguchi | 482/35 |
| 3,730,522 | 5/1973 | Paczkowski | 482/35 |
| 3,742,908 | 7/1973 | Meriao | 119/15 |
| 3,859,961 | 1/1975 | Willinger et al. | 119/15 |
| 4,556,391 | 12/1985 | Tardivel et al. | 446/7 |
| 4,723,512 | 2/1988 | Margolis | 119/15 |
| 4,767,334 | 8/1988 | Thorne et al. | 446/7 X |
| 4,896,784 | 1/1990 | Heath | 174/65 R X |
| 4,959,506 | 9/1990 | Petty et al. | 174/521 X |
| 5,186,122 | 2/1993 | Phillips et al. | 119/702 X |
| 5,226,864 | 7/1993 | Showers | 482/35 |

FOREIGN PATENT DOCUMENTS

| | | | |
|---|---|---|---|
| 566161 | 9/1975 | Czechoslovakia | 482/35 |
| 2233366 | 7/1972 | Germany | 482/35 |

*Primary Examiner*—Mickey Yu
*Assistant Examiner*—D. Neal Muir
*Attorney, Agent, or Firm*—Olive & Olive

[57] ABSTRACT

The recreational equipment junction box of the invention comprises a quarter cylindrical hollow box which may be modified and configured in various ways to adapt to the designed application. Primary modifications include number and location of connected tubes, windows and ventilator panels. A further modified use for the junction box is as a control center, simulating the appearance of a vehicle cockpit.

4 Claims, 2 Drawing Sheets

RECREATIONAL EQUIPMENT JUNCTION BOX

This is a file wraper continuation of case 07/954,825 filed Oct. 1, 1992, now abandoned.

FIELD OF THE INVENTION

The present invention relates to recreational equipment of the type providing an enclosure within and through which children may climb.

BACKGROUND ART

Recreational apparatus of the general class to which the present invention pertains incorporates interconnected tubes and other units through which children climb or crawl. The apparatus is usually located out of doors and is usually made of a heavy gauge plastic in varied bright colors. Such apparatus has become popular as an adjunct to certain fast food restaurants as well as to separate recreational establishments.

While the recreational tube structures used are of a fairly large diameter, the children experience some constriction when turning a corner, as well as some difficulty if two children arrive at the same corner simultaneously. Also, tubes are not inherently conducive to the installation of windows, therefore being relatively dark inside.

SUMMARY OF THE INVENTION

The invention disclosed provides a novel and versatile connective unit for use in a children's recreational structure of the type having large size tubes to be crawled and climbed through. The apparatus serves as a connecting junction box to which 1, 2 or 3 tubes may be attached in a variety of angular relationships. The junction box may be used as a transitional space or as an end destination of an enclosed path. The apparatus is adaptable to interior decoration to simulate, for example, a vehicle cockpit and to being lightened and decorated with a variety of window options.

BRIEF DESCRIPTION OF THE DRAWINGS

FIGS. 2A–2F may be viewed as either plan or elevation views depending on the orientation of the unit.

FIG. 2A illustrates the junction box of the invention having a tube connected to each of the square sides thereof.

FIG. 2B illustrates the junction box of the invention having a tube connected to one square side and a tube connected at a 45° angle to the quarter cylindrical side thereof.

FIG. 2C illustrates the junction box of the invention having a tube connected to one square side and a tube connected at a 30° angle to the quarter cylindrical side thereof.

FIG. 2D illustrates the junction box of the invention having a tube connected to each of the square sides and to the quarter cylindrical side thereof.

FIG. 2E illustrates the junction box of the invention having a tube connected to only one of the square sides thereof.

FIG. 2F illustrates the junction box of the invention having a mounting flange connected to a square side and on which the junction box is supported.

Similar identifying numbers are used in all the figures to identify similar parts of the invention.

DESCRIPTION OF THE INVENTION

Figure 1:
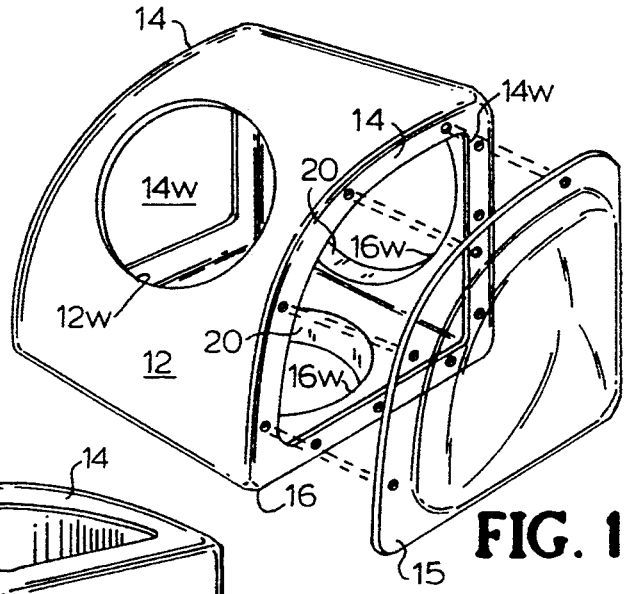
FIG. 1 is a perspective view of a junction box of the invention showing openings in its two square sides and its quarter cylindrical side each adapted for the connection of tubes.

The novel junction box disclosed herein represents a versatile structural component to interconnect and augment the tubing and other related units of children's recreational equipment. FIG. 1 illustrates the basic junction box 10 of the invention which is a hollow quarter cylinder composed of essentially five integrally connected sides; two square sides 16 connected together perpendicularly at a common edge, two quarter disk sides 14 connected perpendicularly at their linear edges to each of the square sides 16 along a second respective edge thereof, and one quarter cylindrical side 12 connected at its two linear edges in perpendicular relation to the two remaining edges of the two square sides 16 and along its quarter circular edges to the circular edges of quarter disk sides 14. Each of the square sides 16 has an opening 16w formed therein and quarter cylindrical side 12 has opening 12w formed therein, each of these three openings adapted to mount to tubular connective pieces. Openings 16w in the square sides 16 are formed in the molding process and have integrally formed therewith a connective tubular neck 20 adapted to mount to a tube (not shown) or similar part. The opening 12w in quarter cylindrical side 12, if desired, is formed by cutting. It is to be noted that junction box 10 may be readily formed by square side 16 being of generally rectangular configuration, although the preferred embodiment employs a square shape therefor.

In its basic form, junction box 10 is molded as a hollow quarter cylindrical shaped box having openings 16w with connective tubular necks 20 integrally formed into the two square sides 16 therewith and adapted to receive and connect a tube so as to extend outwardly from the respective side. Additional sides 12, 14 are initially formed without openings so as to allow the flexibility of design choice to depend upon the relative location and function of the junction box 10 within the recreational structure. Junction box 10 is preferably made of medium density polyethylene resin by a rotational molding process. This material combines the desirable properties of resilient durability, ease of machining, color retention and structural strength. In the process of modifying the initially molded junction box 10 into the various forms described below as examples, a number of openings of differing size and shape are cut through quarter disk sides 14 and/or quarter cylindrical side 12. Depending on the style, design and shape, a convex transparent panel 15 or a planar or curved transparent panel is attached to cover the openings formed as described below. FIG. 1 shows one opening 14w formed by cutting in each quarter disk side 14, one of which openings 14w having transparent convex panel 15 positioned for assembly thereto by bolts or other attachment means.

Figure 2A:
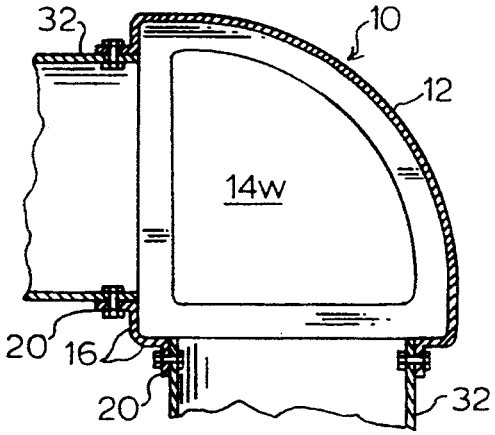
FIGS. 2A–2F in general show a number of different connective configurations of the junction box of the invention shown in section illustration for clarity.

FIGS. 2A–2F illustrate junction box 10 and one or more tubes 32 connected thereto in a variety of locations and orientations which represent a number, but not all possible embodiments of the present invention. The range of choices shown in FIGS. 2A–2F and others not shown allow the designer of a recreational structure great flexibility of arrangement, orientation and function. FIG. 2A shows junction box 10 with tubes 32 connected to its two square sides so that tubes 32 are essentially at right angles to each other. This arrangement creates a turning place with entry and exit tubes for the user to move through. As will be apparent, any particular flat side of the structure represented by FIG. 2A may be oriented in a horizontal, a vertical or other plane, thus further enhancing the variety of choices available to construct a recreational apparatus.

Figure 2D:
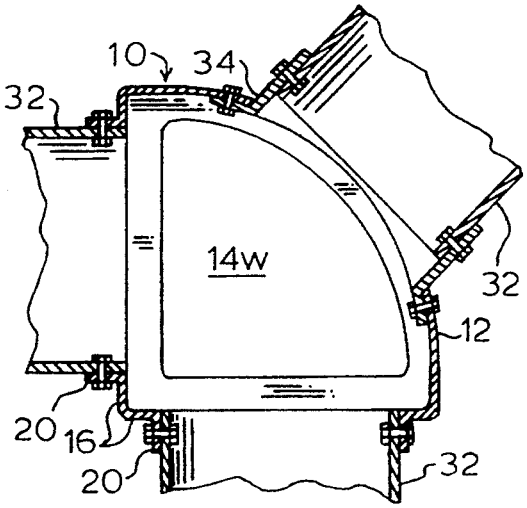
Figure 2B:
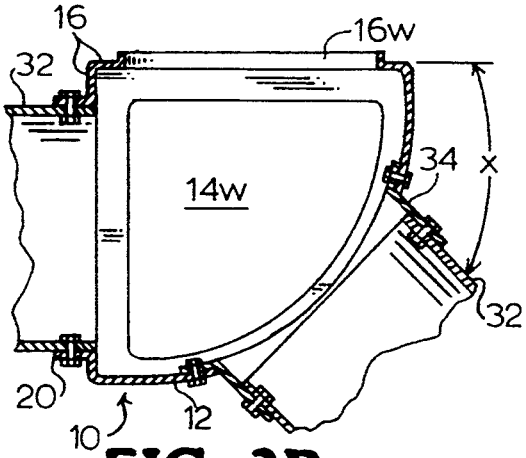

FIG. 2B shows junction box 10 with one tube 32 connected to one square side 16 and another tube 32 connected to the quarter cylindrical side 12 at an angle X of essentially 45°. A tube connecting adapter, comprising the curved connective tubular neck 34, is molded of similar plastic material as that of junction box 10 and is shaped to conform to the curvature of the exterior of quarter cylindrical side 12 and is mounted thereon after a suitably sized opening is cut in side 12. In this arrangement, the second opening 16w in the square side 16 to which no tube is connected is optionally capped with either a transparent window panel or an opaque cover (see FIG. 2E).

Figure 2E:
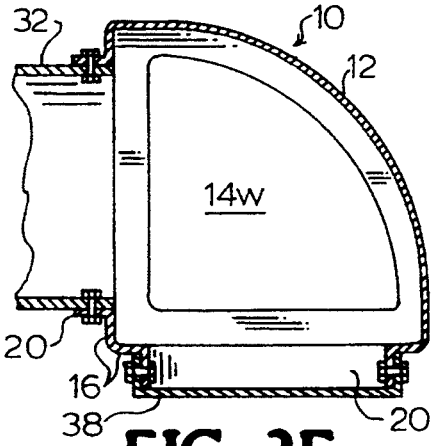
Figure 2C:
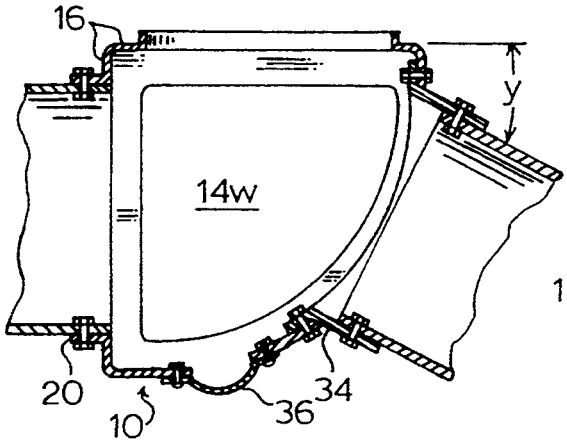

FIG. 2C illustrates junction box 10 in a similar arrangement to that of FIG. 2B, but with the angle Y at which tube 32 is connected to quarter cylindrical side 12 being substantially 30°. The choice of angle between a square side 16 of junction box 10 and a tube 32 connected to the quarter cylindrical side 12 dictates the position along the curve of quarter cylindrical side 12 where opening 12w is cut and where, therefore, curved connective tubular neck 34 is mounted. When the angle Y is in the range of 30° or less, as shown, a window, may be installed by cutting an opening and mounting a window such as convex window 36 thereto. Window 36 is preferably formed of transparent plastic material.

FIG. 2D shows three tubes 32 connected to junction box 10, two of which being connected to the two square sides 16 and one being connected to the quarter cylindrical side 12, so as to form a three-way junction. The various tubes 32 connected in various orientations to junction box 10 may, of course be used as entry or exit tubes interchangeably.

FIG. 2E shows junction box 10 having a single tube 32 connected to one square side 16. The preformed opening 16w in second square side 16 is covered by cap 38 which may optionally be either clear or opaque. In this configuration, the single tube 32 serves as the only entry to and exit point of junction box 10. As will be further described below, various window openings may be formed in other sides of junction box 10 to increase the interior light, general attractiveness and user interest.

Figure 2F:
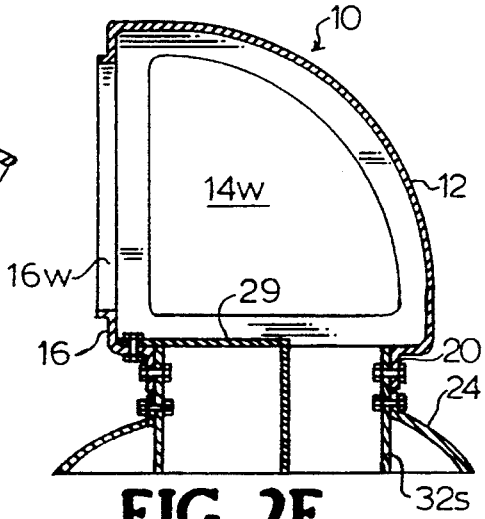

FIG. 2F illustrates an embodiment of junction box 10 which functions without any tubes connected thereto. In this configuration, junction box 10 serves as a "control center" or play cockpit in a stand-alone mode. Junction box 10 is mounted at one of its square sides 16 with connective tubular neck 20 attached to internal short tube 32s extending down to the floor. Short tube 32s connects to mounting flange 24, which, in turn, is mounted to a stable mounting surface. While illustrated as being mounted to a horizontal surface, mounting flange 24 may mount to a vertical surface or an angled surface within the scope of the invention. A seat 29, having a planar vertical front panel configured to allow space for the feet of the child user, is bolted to square side 16. The horizontal top panel of seat 29 is configured to mate with and bolt to the interior horizontal lip of square side 16. Details of this embodiment are disclosed below.

Figure 3:
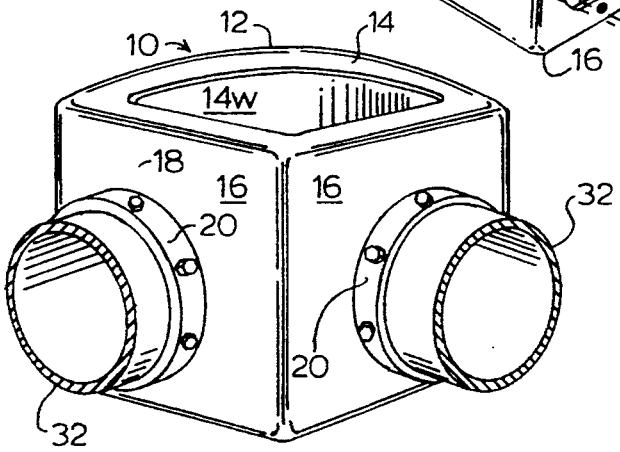
FIG. 3 is a perspective view of the junction box of the invention showing tubes connected to each of the square sides thereof.

Having thus described the overall connection and function of junction box 10, attention is now drawn to FIG. 3 which shows a perspective view which is of a similar configuration to that of FIG. 2A. As is seen here, junction box 10 is substantially larger in internal cross section than attached tubes 32 so as to permit more free movement of the users inside. In the practice according to the preferred embodiment, tube 32 is 30 inches in diameter and junction box 10 is 40 inches along the common edge of square sides 16.

It is to be noted that tubes 32 are formed somewhat smaller in diameter so as to mount internally to connective tubular neck 20 and to obtain a relatively smooth internal transition joint between these two parts. A series of nuts and bolts 18 are installed through mating walls of connective portion 33 and connective tubular neck 20 for assembly. This means of attachment, while preferred for its flexibility and ability to change parts, is not a specific requirement of the invention. Different attachment means may be employed as desired. It is also preferred, when using nuts and bolts 18 to add a soft outer cap (not shown) over the protruding portion of the bolt so as to avoid injury to the users.

Figure 4:
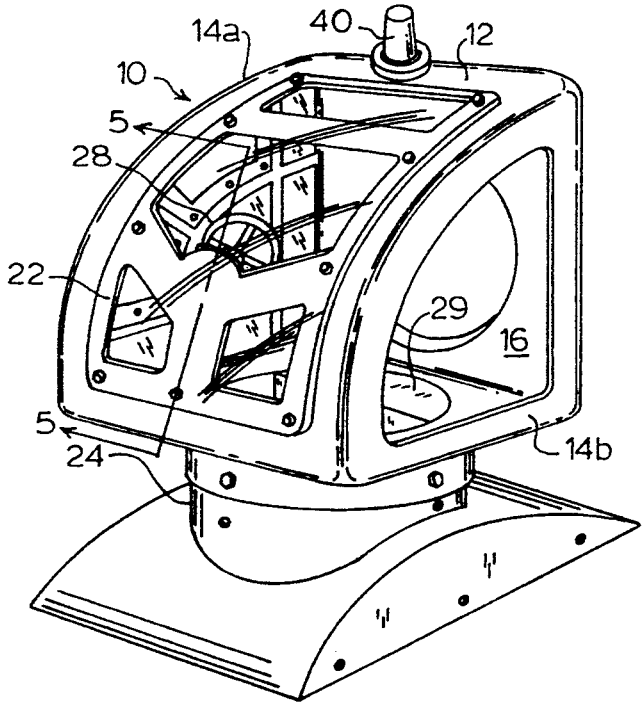
FIG. 4 is a perspective view of the junction box of the invention mounted on a flanged base to function as a control center.

A variation of the use of junction box 10 is illustrated in FIG. 4 wherein junction box 10 is formed as a simulated play control center. Control center use may involve connective tubing as shown in FIG. 2E or may stand alone as in FIG. 2F and FIG. 4. The objective of a control center configuration is to simulate the cockpit of a contemporary or ultramodern vehicle to the mind of the child user. Junction box 10 attaches, as per prior explanation, to mounting flange 24. Mounting flange 24 is attached by means of bolts or other appropriate attachment means to a fixed planar surface such as a floor or wall. To further carry out the simulation of a cockpit, window openings are formed through quarter cylindrical side 12 to simulate a cockpit windshield and a beacon 40 is mounted to the exterior top thereof. Curved window cover sheet 22 is shown mounted to either the interior or exterior surface of quarter cylindrical side 12, thus closing the entire grouping of window openings formed therein.

Quarter disk side **14*a* has a pattern of radially configured openings which, in most uses will be covered with a single sheet of clear window material. For reasons of toughness and clarity, the preferred material for use as a window covering material is polycarbonate clear sheet, either flat or formed to a particular shape. The single large opening formed in quarter disk side 14*b* may be closed with a clear sheet or may be left open as an entry port, depending on the equipment design and the relative location of this particular junction box 10**. Windows or openings may be formed either by cutting through an otherwise solid section of wall or by premolding the desired openings. A further choice to block a window opening is to install a perforated panel (not shown) which primarily will function to aid with air circulation.

Figure 5:
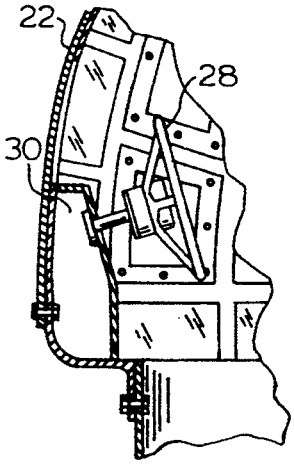
FIG. 5 is a sectional view taken along lines 5—5 of FIG. 4.

Additional details of a particular cockpit configuration are shown in FIG. 5 as a cross section view through a portion of FIG. 4. Play wheel 28 as representative of a variety of simulative control mechanisms, is mounted to instrument panel 30 adjacent the simulated windshield in quarter cylindrical side 12 at an angle to be appropriate to the child user.

Whereas the disclosure herein has been related to particular configurations and embodiments of the invention, it will be understood by those skilled in the art that many further variations of the general principles related are possible within the scope and spirit of the invention.

What is claimed is:

1. A connective junction box for tubular recreational equipment, comprising:

(a) a hollow quarter cylindrical box having substantially thin sides;

(b) one or more of said sides being formed with a substantially cylindrical opening surrounded by an integrally formed connective neck adapted for the connection of an external tube;

(c) a tube securely connected to each said connective neck and extending outwardly of said box; and (d) at least one of said sides having an opening covered by a substantially transparent panel adapted to provide visibility for a child within said box.

2. A connective junction box for tubular recreational equipment, comprising;

(a) a hollow quarter cylindrical box bounded by substantially thin sides and providing an enclosed space for receiving a child;

(b) selected of said sides each being formed with an opening therethrough adapted to permit ingress and egress of a child;

(c) connecting means appurtenant each said opening adapted to receive and connect a tube;

(d) a tube received by and connected to each said connecting means and extending outwardly from the respective each selected side; and (e) at least one of said sides not receiving a tube being formed with an opening covered by a substantially transparent panel.

3. The connective junction box as described in claim 2, wherein each said connecting means comprises a tubular cylindrical connective neck member formed integral with said box, surrounding each said opening and configured to receive the respective each said tube.

4. The connective junction box as described in claim 2, further comprising a simulated play control mechanism located within said junction box enclosed space.

* * * * *